US008597445B2

(12) United States Patent
Pile et al.

(10) Patent No.: US 8,597,445 B2
(45) **Date of Patent: *Dec. 3, 2013**

(54) BISMUTH OXIDE PRIMER COMPOSITION

(75) Inventors: Donald A. Pile, Cabot, AR (US); Henry J. John, Jr., Jacksonville, FL (US)

(73) Assignee: RA Brands, L.L.C., Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/363,720

(22) Filed: Feb. 1, 2012

(65) Prior Publication Data

US 2012/0125493 A1 May 24, 2012

Related U.S. Application Data

(60) Division of application No. 11/087,274, filed on Mar. 23, 2005, now Pat. No. 8,128,766, which is a continuation-in-part of application No. 10/764,246, filed on Jan. 23, 2004.

(51) Int. Cl.

| | |
|---|---|
| ***C06B 33/00*** | (2006.01) |
| ***C06B 33/10*** | (2006.01) |
| ***C06B 33/12*** | (2006.01) |
| ***D03D 23/00*** | (2006.01) |
| ***D03D 43/00*** | (2006.01) |

(52) U.S. Cl.
USPC ..... 149/39; 149/37; 149/40; 149/108.6; 149/109.2; 149/109.4; 149/109.6

(58) Field of Classification Search
USPC ..... 149/39, 37, 40, 108.6, 109.2, 109.4, 149/109.6
See application file for complete search history.

(56) References Cited

U.S. PATENT DOCUMENTS

| | | | | |
|---|---|---|---|---|
| 1,930,653 | A | 10/1933 | McNutt | |
| 2,111,203 | A | 3/1938 | Brün | |
| 3,155,553 | A | 11/1964 | Taylor et al. | |
| 3,622,408 | A | 11/1971 | Lyerly | |
| 3,719,148 | A | 3/1973 | Gawlick | |
| 3,793,920 | A | 2/1974 | Sheran | |
| 4,092,186 | A | 5/1978 | Gordon et al. | |
| 4,094,028 | A | 6/1978 | Fujiyama et al. | |
| 4,243,444 | A | 1/1981 | Alley et al. | |
| 4,280,409 | A | 7/1981 | Rozner et al. | |
| 4,363,679 | A | 12/1982 | Hagel et al. | |
| 4,372,213 | A | 2/1983 | Rozner et al. | |
| 4,386,567 | A | 6/1983 | Ciccone et al. | |
| 4,398,977 | A | 8/1983 | Webster, III | |
| 4,419,153 | A | 12/1983 | Boberg | |
| 4,522,665 | A | 6/1985 | Yates, Jr. et al. | |
| 4,557,771 | A | 12/1985 | Bencz et al. | |
| 4,581,082 | A | 4/1986 | Hagel et al. | |
| 4,674,409 | A | 6/1987 | Lopata et al. | |
| 4,853,052 | A * | 8/1989 | Calsson et al. | 149/109.6 |
| 4,994,125 | A | 2/1991 | Mei | |
| 5,167,736 | A | 12/1992 | Mei et al. | |
| 5,216,199 | A | 6/1993 | Bjerke et al. | |
| 5,221,808 | A | 6/1993 | Werner et al. | |
| 5,339,624 | A | 8/1994 | Calsson et al. | |
| 5,372,070 | A | 12/1994 | Neidert et al. | |
| 5,388,519 | A | 2/1995 | Guindon et al. | |
| 5,413,048 | A | 5/1995 | Werner et al. | |
| 5,463,956 | A | 11/1995 | Harting | |
| 5,472,534 | A | 12/1995 | Wardle et al. | |
| 5,472,647 | A | 12/1995 | Blau et al. | |
| 5,501,823 | A | 3/1996 | Lund et al. | |
| 5,538,569 | A | 7/1996 | Carter | |
| 5,561,260 | A | 10/1996 | Towning et al. | |
| 5,567,252 | A | 10/1996 | Mei et al. | |
| 5,567,906 | A | 10/1996 | Reese et al. | |
| 5,585,594 | A | 12/1996 | Pelham et al. | |
| 5,610,367 | A | 3/1997 | Erickson et al. | |
| 5,639,987 | A | 6/1997 | Berteleau et al. | |
| 5,646,367 | A | 7/1997 | Shanks et al. | |
| 5,652,409 | A | 7/1997 | Thompson et al. | |
| 5,654,520 | A * | 8/1997 | Boberg et al. | 102/205 |
| 5,656,791 | A | 8/1997 | Reese et al. | |
| 5,682,014 | A | 10/1997 | Highsmith et al. | |
| 5,684,268 | A | 11/1997 | Lopata | |
| 5,831,208 | A | 11/1998 | Erickson | |
| 5,970,703 | A | 10/1999 | Hinshaw et al. | |
| 5,993,577 | A | 11/1999 | Erickson et al. | |
| 6,024,810 | A | 2/2000 | Neidert et al. | |
| 6,066,214 | A | 5/2000 | Comfort | |
| 6,183,574 | B1 | 2/2001 | Warren | |
| 6,190,474 | B1 | 2/2001 | Yamato | |
| 6,241,281 | B1 | 6/2001 | Hinshaw et al. | |
| 6,274,064 | B1 | 8/2001 | Wheatley | |
| 6,478,903 | B1 * | 11/2002 | John et al. | 149/18 |
| 6,503,350 | B2 | 1/2003 | Martin et al. | |
| 6,517,647 | B1 | 2/2003 | Yamato | |
| 6,878,221 | B1 * | 4/2005 | Mei et al. | 149/41 |
| 2001/0000387 | A1 | 4/2001 | Yamato | |
| 2002/0007886 | A1 | 1/2002 | Neidert et al. | |
| 2002/0053377 | A1 | 5/2002 | Martin et al. | |
| 2002/0117071 | A1 | 8/2002 | Kaliszewski | |
| 2003/0019387 | A1 | 1/2003 | Yamato et al. | |
| 2003/0030162 | A1 | 2/2003 | Yamamoto et al. | |

FOREIGN PATENT DOCUMENTS

| | | |
|---|---|---|
| DE | 196 25 897 A1 | 1/1997 |
| EP | 0 310 580 | 4/1989 |
| EP | 0 599 792 | 6/1994 |
| EP | 0 699 646 | 3/1996 |
| EP | 0 538 135 | 5/1997 |
| EP | 0 861 817 | 9/1998 |
| EP | 0 997 449 | 5/2000 |
| EP | 1 195 366 | 4/2002 |
| SE | 9203571-6 | 7/1994 |
| WO | WO 97/16397 | 5/1997 |
| WO | WO 99/44968 | 9/1999 |
| WO | WO 01/10677 | 2/2001 |
| WO | WO 01/21588 | 3/2001 |
| WO | WO 2006/009579 | 1/2006 |

OTHER PUBLICATIONS

International Search Report for PCT/US05/02048 dated Nov. 24, 2005.
Written Opinion for PCT/US05/02048 dated Nov. 24, 2005.

* cited by examiner

*Primary Examiner* — James McDonough
(74) *Attorney, Agent, or Firm* — Womble Carlyle Sandridge & Rice, LLP

(57) ABSTRACT

A priming mixture is provided having a primary explosive and an oxidizer system containing bismuth oxide. The priming mixture generally is applicable to any application or device that employs ignition of a propellant or fuel, including, but not limited to, air bag gas generator systems, signaling devices, ejection seats, small or large arms ammunition primers, and the like.

20 Claims, No Drawings

BISMUTH OXIDE PRIMER COMPOSITION

PRIOR RELATED APPLICATION DATA

The present patent application is a division of, and claims benefit of, previously filed co-pending U.S. patent application Ser. No. 11/087,274, filed Mar. 23, 2005, which is a continuation-in-part application of, and claims benefit of, previously filed U.S. patent application Ser. No. 10/764,246, filed Jan. 23, 2004, by the inventors named in the present application. The specifications and drawings of each of these applications are specifically incorporated herein by reference as if set forth in their entireties.

TECHNICAL FIELD

The present invention generally relates to primer charges or mixes and more particularly to priming mixes for small arms ammunition or other applications that employ ignition of a propellant or fuel.

BACKGROUND

The smallest component in small arms ammunition, the primer, is the link between the striking of the firing pin and the explosion of the projectile out of the cartridge casing. Generally, most common primer mixes are comprised of a primary explosive, an oxiding agent and a fuel source. Percussion primers and/or primer mixes have undergone relatively few gradual changes since their original development. In early primers, mercury fulminate was the most commonly used primer mix. Since that time, alternate priming mixes have replaced mercury fulminate, as this latter composition was found to deteriorate rapidly under tropical conditions and cause potential health problems or concerns such as lethargy and nausea to the shooter after firing. Such alternate mixes, typically based on lead thiocyanate/potassium chlorate formulations, however, were found to be detrimental to weapon barrels because of the formation of corrosive water soluble potassium chloride salts upon combustion. More conventional primer mixes currently in use typically are based on the primary explosive lead styphnate, a substance which is much more stable than mercury fulminate and is in common use today.

Although more stable and less corrosive than earlier primer mixes, the use of lead styphnate-based primers has become more of a concern recently due to increasing awareness of the health hazards of lead. While considerable attention has been directed to removing lead from primer mixes, however, there has been less attention paid to the removal of the remaining toxic components from the primer mix. One of most common oxidizing agents used in conventional primer mixes is barium nitrate. Unfortunately, barium is highly toxic, and therefore poses a potential health hazard, particularly when used within an enclosed shooting area where it can accumulate in the atmosphere and on surfaces. Generally, a typical small arms primer contains between 30% and 50% oxidizer, so replacing barium nitrate with a non-toxic oxidizer greatly reduces the post-ignition airborne hazards.

Alternative oxidizers, such as potassium nitrate, have been found to perform as well as barium nitrate under certain circumstances or conditions. For example, inorganic nitrate salts perform very well as oxidizing agents in pyrotechnic formulations because of their relatively low melting points, available oxygen, and their crystalline form; however, such nitrate salts such as potassium nitrate, are hygroscopic, making them very susceptible to the effects of atmospheric moisture and inappropriate for use in certain storage conditions. Since priming formulations typically are assembled in high moisture environments to escape unintended ignition by heat, shock, or impact, many oxidizers, such as inorganic nitrates, can cause deleterious side chemical reactions when combined with other ingredients under such high-moisture conditions. Such reactions produce an inferior product with reduced sensitivity to impact and thus ignition, consequently increasing potential failure rates for such primers.

Accordingly, there exists a need for a priming mixture for small arms ammunition that addresses the foregoing and other related and unrelated problems in the art.

SUMMARY

Briefly described, the present invention generally encompasses compositions and methods of preparing priming mixtures for small arms ammunition comprising oxidizer systems containing bismuth oxide, as well as small arms ammunition cartridges that incorporate such priming mixtures. Because the priming mixture of this invention has the ability to ignite propellants and fuels, it is also suited for applications other than small arms ammunition primers, including, but not limited to, igniters for an air bag gas generator system, igniters for signaling devices, igniters for ejection seats, and the like. Therefore in one aspect, the priming mixture of this invention is generally applicable to any apparatus, device, method, or application that utilizes a priming mixture to ignite propellants and fuels, regardless of how that priming mixture is activated. The oxidizer systems can include bismuth oxide alone or in combination with one or more other oxidizers. The priming mixtures further generally will include one or more primary explosives combined with oxidizer systems containing bismuth oxide. In one embodiment, the oxidizer systems containing bismuth oxide are non-hygroscopic and non-corrosive. The priming mixtures of the present invention further can be non-toxic and substantially free of lead, or can contain some lead compound, such as lead styphnate as a primary explosive charge while substantially reducing the overall content of toxic materials in the priming mixture.

In one embodiment, the priming mixtures of the present invention include a primary explosive and a non-hygroscopic, non-corrosive oxidizer system comprising bismuth oxide. The primary explosive may be selected from, for example, heavy metal salts of trinitroresorcinol, salts of dinitrobenzofuroxan, diazodinitrophenol, and the like, and combinations thereof. The primary explosive also may include a lead-based compound such as lead styphnate. In addition to bismuth oxide, the non-hygroscopic, non-corrosive oxidizer system may include one or more additional oxidizer compounds or elements, such as potassium nitrate, zinc peroxide, manganese dioxide, molybdenum trioxide, strontium nitrate, strontium peroxide, tin oxide, iron oxide and combinations thereof. Still further, the priming mixtures containing a primary explosive and a non-hygroscopic, non-corrosive oxidizer system comprising bismuth oxide also may include one or more reducing agents, gas producing agents and sensitizers to provide the desired or required performance characteristics for supplying a priming charge to a round of small arms ammunition.

In another embodiment, the present invention includes priming mixtures for small arms ammunition and other applications that employ igniting a propellant or fuel, comprising approximately 20-70% by weight of a primary explosive, such as a lead-free explosive or a lead-based compound such as lead styphnate, and approximately 10-70% by weight of an oxidizer system comprising bismuth oxide. In another embodiment, the priming mixture of this invention comprises: about 25% to about 50% by weight of a primary explosive; and about 25% to about 55% by weight of an oxidizer system comprising bismuth oxide. These priming mixtures optionally may include approximately 0-25% by weight of a gas producing agent, approximately 0-20% by weight of a sensitizer, and approximately 0-20% by weight of a reducing agent. The oxidizer systems of these priming mixtures may include, in addition to bismuth oxide, oxidizers selected from potassium nitrate, zinc peroxide, manganese dioxide, molybdenum trioxide, strontium nitrate, strontium peroxide, barium nitrate, tin oxide, iron oxide and combinations thereof. The gas producing agents may be selected from pentaerythritol tetranitrate, trinitrotoluene and/or combinations thereof, while the reducing agents may be selected from aluminum, boron, calcium silicide, magnesium, magnesium-aluminum alloy, silicon, titanium, tungsten, zirconium and combinations thereof.

The priming mixtures typically are wet processed during production for safety, and are formed by methods comprising combining and mixing water with a primary explosive and an oxidizer system comprising bismuth oxide. In alternative embodiments, one or more reducing agents, gas generating agents or sensitizers also can be added during combination and mixing to form the priming mixtures of the present invention. In a further embodiment, water may be combined and mixed with, on a dry weight percent basis, approximately 20-70% by weight of a primary explosive, approximately 10-70% by weight of an oxidizer system comprising bismuth oxide, approximately 0-25% by weight of a gas producing agent, approximately 0-20% by weight of a sensitizer, and approximately 0-20% by weight of a reducing agent. The wet formed priming mixture then can be rolled and charged into percussion cups.

These and other aspects of the present invention are set forth in greater detail below.

DETAILED DESCRIPTION

The present invention generally is directed to priming mixtures containing bismuth oxide primarily for use in small arms ammunition and other applications that employ igniting a propellant or fuel. The priming mixtures generally include a primary explosive and an oxidizer system containing bismuth oxide by itself or in combination with one or more other oxidizers. Other priming components, such as gas producing agents, sensitizers, and reducing agents or fuels also may be included in the priming mixtures of the present invention. Therefore, the priming mixture of this invention is generally applicable to any apparatus, device, method, or application that utilizes a priming mixture to igniting a propellant or fuel. These priming mixtures can be incorporated into small arms ammunition primers or cartridges, which also are encompassed by the present invention.

The present invention generally is also directed to priming mixtures containing bismuth oxide, for applications other than in small arms ammunition that employ ignition of a propellant or fuel. The priming mixtures for these applications generally include a primary explosive and an oxidizer system containing bismuth oxide by itself or in combination with one or more other oxidizers. Other priming components, such as gas producing agents, sensitizers, reducing agents, fuels, binders, conductive components, or any combination thereof, also may be included in the priming mixtures of the present invention. These priming mixtures can be incorporated into any device or apparatus that requires an ignition source which is generated by the stimulus of an impact, or incorporated into any device or apparatus that requires an ignition source which is generated by en electrical stimulus, for example, when conductive components are included in the priming mixture.

Accordingly, the present invention encompasses a device that is activated by ignition of a propellant or fuel, that generally comprises:

a priming mixture comprising a primary explosive and an oxidizer system, wherein the oxidizing system comprises bismuth oxide; and a propellant or fuel adapted to be initiated by, and in contact with, the priming mixture.

Examples of applications and devices that can employ the priming mixtures of this invention include, but are not limited to, a seat belt tensioner, an air bag, a signal flare, a hand grenade, a mechanical launch grenade, a smoke grenade, a restraint system, an ejection seat, an explosive canopy, a drogue chute extractor, an aerial decoy, a powered hand tool, an industrial tool, a fastening device, a grenade launcher, a gas grenade, a stun grenade, a sub-munition, a projectile launcher, a pyrotechnic initiation delay device, an impulse motor, a delay detonator, a blasting cap, a rock crusher, a cable cutting device, a seismic explosive device, an explosive projectile, a shaped charge, a wellbore perforating apparatus, an anti-armor warhead, a muzzle-loading firearm, a burrowing animal exterminating device, a predator control device, an igniter for starting fires, an ignition system for chemical heaters, and the like.

A number of U.S. patents disclose and describe various applications and devices which can employ the priming mixture of the present invention, examples of which include, but are not limited to: U.S. Pat. No. 6,139,058 (seat belt tensioner); U.S. Pat. No. 6,095,556 (air bag); U.S. Pat. No. 4,029,014 (signal flare); U.S. Pat. No. 4,333,401 (hand grenade); U.S. Pat. No. 5,355,803 (mechanical launch grenade); U.S. Pat. No. 4,353,301 (smoke grenade); U.S. Pat. No. 4,247,064 (restraint system); U.S. Pat. No. 3,979,088 (ejection seat); U.S. Pat. No. 5,072,896 (explosive canopy); U.S. Pat. No. 4,004,764 (drogue chute extractor); U.S. Pat. No. 4,171,669 (aerial decoy); U.S. Pat. No. 6,851,262 (powered hand tool); U.S. Pat. No. 5,329,855 (industrial tools); U.S. Pat. No. 5,842,623 (fastening device); U.S. Pat. No. 4,689,912 (grenade launcher); U.S. Pat. No. 5,654,523 (gas grenade); U.S. Pat. No. 5,654,523 (stun grenade); U.S. Pat. No. 6,848,367 (sub-munition); U.S. Pat. No. 6,688,032 (projectile launcher); U.S. Pat. No. 6,578,489 (pyrotechnic initiation delay device); U.S. Pat. No. 5,069,135 (impulse motor); U.S. Pat. No. 4,429,632 (delay detonator); U.S. Pat. No. 6,581,519 (blasting cap); U.S. Pat. No. 6,457,416 (rock crusher); U.S. Pat. No. 4,185,551 (cable cutting device); U.S. Pat. No. 4,867,266 (seismic explosive device); U.S. Pat. No. 5,652,408 (explosive projectile); U.S. Pat. No. 6,510,796 (shaped charge); U.S. Pat. No. 5,191,933 (wellbore perforating apparatus); H1,504 (anti-armor warhead); U.S. Pat. No. 5,408,776 (muzzle-loading firearm igniter); U.S. Pat. No. 4,512,102 (burrowing animal exterminating device); U.S. Pat. No. 4,473,968 (predator control device); U.S. Pat. No. 4,086,049 (igniter for starting fires); U.S. Pat. No. 4,013,061 (ignition system for chemical heaters); and the like. Each of the U.S. patents is incorporated herein by reference in its entirety, for the purposes of describing and disclosing, for example, the various constructs and methodologies which can be used in connection with the priming mixture of the present invention. This disclosure is not to be construed as any statement that the inventors are not entitled to antedate such disclosure by virtue of prior invention. To the extent that any definition or usage provided by any document incorporated herein by reference conflicts with the definition or usage provided herein, the definition or usage provided herein controls.

Bismuth oxide as used herein is also referred to as bismuth (III)oxide or $Bi_2O_3$. As used herein, the term "small arms ammunition" refers to ammunition for a firearm capable of being carried by a person and fired without mechanical support and typically having a bore diameter of about one inch or less. The term "priming mixture", as used herein, refers to a combination of explosive and/or pyrotechnic type ingredients, which, when pressed into caseless ammunition or a primer cup or spun into the rim cavity of a rimfire shell, will explode or deflagrate upon impact by a firing-pin with the round of ammunition to ignite the propellant of the round and fire the bullet or slug of the round. The term "primary explosive" generally refers to a sensitive explosive which nearly always detonates by simple ignition from an energy source of appropriate magnitude for a small arm, such as spark, flame, impact and other primary heat sources. The term "primary explosive" further generally includes, but is not limited to, mercury fulminate, lead azide, lead styphnate, silver azide, diazodinitrophenol (DDNP), tetrazene, potassium dinitrobenzofuroxane (KDNBF), heavy metal salts of 5-nitrotetrazole and other compounds that exhibit performance characteristics of handling, storage or detonation similar to these example compounds.

As used herein, the term "non-corrosive primer" refers to a primer which does not contain chemical compounds that typically will produce corrosion or rust in a gun barrel. The term "substantially free of lead", as used herein, refers to the complete absence of lead or the presence of lead in a trace amount or an amount that would not be considered toxic. As used herein, the term "non-toxic" refers to a compound or mixture that contains no more than trace amounts of lead, manganese, antimony and barium, or amounts of these compounds that are considered to be non-detrimental to human health. The term "non-hygroscopic", as used herein, generally refers to an article, compound, or system that does not readily taking up and retain moisture, especially when exposed to humidity. Additionally, the term "cartridge", as used herein, refers to a round of ammunition comprising a case, as well as caseless ammunition, and having a priming mixture and propellant with or without one or more projectiles.

The present invention generally is directed to priming mixtures comprising an oxidizer system containing bismuth oxide. The oxidizer system can include bismuth oxide alone or in combination with one or more other or secondary oxidizers, such as potassium nitrate, zinc peroxide, manganese dioxide, molybdenum trioxide, strontium nitrate, strontium peroxide, barium nitrate, tin oxide, and iron oxide. These secondary oxidizers can be present in the oxidizer system in a range of generally about 0% to particularly about 99% by weight, about 10% to about 90% by weight, and more particularly about 30% to about 60% by weight. Although bismuth oxide has a relatively high melting point of 817° C. as compared to other oxidizers commonly used in small arms ammunition priming mixtures, bismuth oxide is substantially non-hygroscopic and non-toxic, thereby providing certain advantages in storage, handling and use that are not found in other oxidizers. Bismuth oxide also has a texture that allows it flow with ease when blended in the traditional manner in which primer formulations are blended to thus provide a substantially homogenous mixture without having to incorporate flowing agents or implement strenuous particle size control procedures. Therefore, the oxidizer systems of the present invention can be substantially free of flowing agents and can exhibit a range of particle sizes that is broader than those found in conventional homogenous oxidizer systems. A substantially homogeneous priming mixture generally is easier to measure out into the primer cup and process than non-homogeneous mixtures that commonly arise with traditional oxidizer systems. Furthermore, raw dry and wet priming mixtures formed with bismuth oxide generally are less sensitive to external stimulus, such as impact or friction, than those formed with traditional oxidizer systems, thus making the mixtures containing bismuth oxide generally safer to handle, process, and utilize.

In particular embodiments, the priming mixtures of the present invention can include from about 10% to about 70% by weight of an oxidizer system comprising bismuth oxide alone or in combination with one or more other oxidizers, although greater or lesser amounts of the oxidizer can be used. In certain embodiments, the priming mixtures can contain about 25% to about 55% by weight of an oxidizer system including bismuth oxide. This bismuth oxide can constitute anywhere from about 1% up to about 100% by weight of the oxidizer system, and particularly about 5% to about 100% by weight of the oxidizer system.

In addition to a bismuth oxide oxidizer system, the priming mixtures of the present invention generally include one or more primary explosives, such as, for example, lead salts of trinitroresorcinol, diazodinitrophenol, or earth metal salts of dinitrobenzofuroxan. Generally, the priming mixture of this invention can employ any primary explosive in combination with the bismuth oxide oxidizer system. Examples of primary explosives that can be used with bismuth oxide oxidizer system include, but are not limited to, salts of trinitroresorcinol (TNR), salts of dinitrobenzofuroxan (DNBF), diazodinitrophenol (DDNP), salts of fulminate, salts of hydrazoic acid, tetrazene, salts of tetrazene, silver salt of tetrazene, cuprous salt of tetrazene, salts of amino guanidine, salts of cyanamide, nitrocyanamide salts, nitrophenol salts, nitrosophenol salts, nitramine salts, salts of metazonic acid, oxalic salts, peroxides, acetylide salts, nitrogen sulphide, nitrogen selenide, thiocyanic salts, silver perchlorate, hexanitromannitol, and the like, including any combination thereof.

Generally, any primary explosive can be used with bismuth oxide oxidizer system. A further listing of primary explosives that are useful in this invention, including a non-limiting listing of the various salts that can be used, appears in *Chemistry and Technology of Explosives* by Tadeusz Urbanski; MacMillan Publishing Company, 1984; reprinted by Pergamon Press, 1990, which is incorporated herein by reference in its entirety. However, to the extent that any definition or usage provided by any document incorporated herein by reference conflicts with the definition or usage provided herein, the definition or usage provided herein controls. The term salts is meant to include all salts that can function as primary explosives. For example, the term salts of trinitroresorcinol (TNR) is intended to include, but not be limited to, heavy metal salts such as barium and thallium TNR, and also include double salts such as barium-lead, copper-lead, calcium-barium, and the like. Similarly, the term salts of dinitrobenzofuroxan (DNBF) is meant to include the sodium salt, potassium salt, silver salt, and similar salts.

In one embodiment, the priming mixture includes DDNP as one of the primary explosive constituents. DDNP can be used alone, or in combination with one or more other primary explosives, such as KDNBF, and derivatives and mixtures thereof, in the priming mixture. Alternatively, KDNBF may constitute the only primary explosive of the priming mixtures or comprise one of a combination of primary explosive components, other than DDNP. While DDNP and KDNBF are substantially free of lead and non-toxic, they can be used individually or together in combination with one or more lead-based primary explosives, such as lead styphnate or the like, in the priming mixtures containing bismuth oxide. Generally, the primary explosive, whether composed of a single compound or a combination of two or more compounds, will be selected or designed to have ballistic properties similar to or better than those of lead styphnate.

The priming mixtures of the present invention typically will include one or more primary explosives in a range of about 20% to about 70% by weight of the priming mixture, although it is also possible to utilize greater or lesser percentages by weight of the primary explosive in the primary mixture as well. In one embodiment, the primary explosive constitutes about 25% to about 50% by weight of the priming mixture. In a more particular embodiment, the priming mixture generally comprises about 40% to about 45% by weight of a primary explosive, such as KDNBF or DDNP.

The priming mixtures of the present invention also can include one or more secondary explosives, which typically act as sensitizers that accelerate or otherwise modify the rate of conversion of the pyrotechnic system. There are a variety of sensitizers capable of being included in the present priming mixture. In the present case, the sensitizer is selected, in part, for its compatibility with the chosen primary explosive. The sensitizer can enhance the sensitivity of the primary explosive to the percussion mechanism. In one embodiment, tetrazene is selected as a secondary explosive to be combined with a primary explosive, such as DDNP or KDNBF. Tetrazene, also known as tetracene, tetrazolyl guanyltetrazene hydrate or tetrazene-1-carboxamidine-4-(1-H-tetrazol-5-yl) monohydrate, also can be added to the priming mixture, in combination with DDNP or KDNBF, to increase the sensitivity of the charge.

The priming mixtures also can include sensitizers, typically in an amount from about 0% to about 30% by weight of the priming mixture. The sensitizer can include one or more secondary explosives, such as tetrazene, friction agents, such as ground glass, or other inert substances. In one embodiment, the priming mixture contains about 5% to about 20% by weight of such materials, and in one particular embodiment, tetrazene typically is added to the mix in an amount between about 4 to 11% by weight. For example, tetrazene can comprise about 5% by weight of the priming mixture.

Gas producing agents also can be included in the priming mixtures of the present invention. Single or double based propellants, such as pentaerythritol tetranitrate or trinitrotoluene, can be included to provide sources of expanding gas when the priming mixture is activated. Generally, the priming mixtures can include about 0% to about 25% by weight of one or more gas producing agents. In one particular embodiment, the priming mixture comprises about 5% to about 25% by weight of a gas producing agent.

The priming mixtures further can include one or more fuels or reducing agents. The fuel can be either a metallic fuel or reducing agent, nonmetallic fuel, or combinations thereof. The fuel can constitute from about 0% to about 20% by weight of the priming mixture. Examples of potential fuels or reducing agents include aluminum, boron, calcium silicide, magnesium, magnesium-aluminum alloy, silicon, titanium, tungsten, zirconium and nitrocellulose. In one embodiment, the priming mixture includes about 5% to about 20% by weight of a fuel or reducing agent.

Another aspect of the present invention involves a primer mix that can be used in an electric primer. This electric primer mix typically uses an explosive primer mixture containing a conductive substance therein, such as metal filings or some form of carbon, or both, that can provide many small conduction paths. When the appropriate current passes through the conducting component of the primer mix, it can cause localized heating, a spark, or both, which in turn detonates the explosive primer mixture, and yet exhibits insensitivity to stray electrical charges. While not intending to be bound by theory, it is believed that electrically-conductive components provide a secondary electrical path that assists in the prevention of low voltage initiation. Therefore, this aspect of the invention encompasses primer mixes comprising the disclosed primer mix components in the specified quantities, further comprising an electrically-conductive component.

Any of a number of conductive components can be utilized in this aspect of this invention, including, but not limited to, those disclosed in U.S. Pat. Nos. 5,646,367; 3,793,920; and 3,155,553; each of which is incorporated herein by reference in its entirety. Thus, in this aspect, the primer mix of the present invention can further comprise an electrically-conductive component, selected from aluminum, carbon such as carbon black, titanium, zirconium, silver, gold, uranium, a metal azide such as lead azide or silver azide, or any combinations thereof. When present, the conductive component can be present from about 0% to about 20% by weight of the priming mix, or from about 0.1% to about 10% by weight of the priming mix.

When aluminum is present as an electrically-conductive component, the aluminum can be present in varying amounts, including from about 4% to about 8% by weight, although amounts outside this range can function also. The aluminum used is typically in fine particulate form, having a particle size from about 5 to about 40 micrometers, although other, greater or for example, lesser sizes also can be used.

When carbon is present as an electrically-conductive component, with or without the presence of aluminum, the carbon is typically in the form of carbon black. In this aspect, carbon black can be utilized in various amounts, including from about 0.5% to about 2% carbon black, although amounts outside this range can function also. In this aspect, the presence of carbon black in combination with aluminum, works well.

The conductivity of an electrically-conductive carbon black is influenced by a number of properties, including but not limited to, particle size and surface area. Thus, the particle size of the carbon black can be typically from about 10 nanometers (nm) to about 30 nanometers. Generally, electrical conductivity of carbon black is also improved by increasing the surface area of the particles, typically by increased porosity. The surface area of the carbon black is typically measured as nitrogen surface area, according to ASTM-D-3037. Although nitrogen surface areas of less than about 1000 $m^2/g$ can be used in this invention, nitrogen surface areas of greater than about 1000 $m^2/g$ work well. For example, one carbon black component that can be used in this invention is characterized by a nitrogen surface area of about 1475 $m^2/g$.

Improving the electrical conductivity of carbon black can also occur upon enhancing the aggregate structure of the particles, by lowering the volatile content of the carbon black, or a combination thereof. Lowering the volatile content of the carbon black can typically occur as a result of fewer chemisorbed oxygen complexes on the surface of the carbon black particles. While not intending to be bound by theory, it is thought that the chemisorbed oxygen can act as an insulator, thereby diminishing its conductivity. A volatile content of less than about 5% or less than about 2% works well.

Any type of carbon black that provides the required conductivity can be employed in this invention. For example, furnace black works well for any primer application of this invention. Acetylene blacks can also be employed, and are especially useful in large caliber military electric primers.

Accordingly, in another example embodiment, the present invention provides a priming mixture generally comprising:

- from about 20% to about 70% by weight of a primary explosive;
- from about 10% to about 70% by weight of an oxidizer system comprising bismuth oxide;
- from about 0% to about 25% by weight of a gas producing agent;
- from about 0% to about 20% by weight of a sensitizer;
- from about 0% to about 20% by weight of a reducing agent; and
- from about 0% to about 20% by weight of a conductive component.

In this embodiment, the priming mixture can comprise from about 25% to about 50% by weight of the primary explosive, from about 25% to about 55% by weight of the oxidizer system, from about 5% to about 25% by weight of the gas producing agent, from about 5% to about 20% by weight of the sensitizer, from about 5% to about 20% by weight of the reducing agent, from about 0.1% to about 10% by weight of a conductive component, or any combination of these ranges.

The primer mixtures also can contain a binder that is generally included up to about 2% by weight to minimize dusting. The binder typically can constitute about 0.5 to about 1.5% by weight of the priming mixture although other, varying amounts also can be used. The binder generally is chosen for maximum compatibility with the explosive formulation prepared, and typically will be selected from a variety of gum materials, such as gum arabics, and particularly acacia gum arabic, as well as carboxy methylcellulose, ethyl cellulose, and guar tragacanth, polyvinyl alcohol with guar gum.

In still a further embodiment, the present invention can include a device or system that is activated by ignition of a propellant or fuel, generally comprising:

a priming mixture comprising a primary explosive and an oxidizer system, wherein the oxidizing system comprises bismuth oxide; and a propellant or fuel adapted to be initiated by, and in contact with, the priming mixture.

The disclosed components of the priming mixtures can be combined and wet mixed by the use of standard low shear mixers, using customary techniques for blending explosives. The components typically are wet-mixed for safety since the explosive compounds are desensitized when mixed with water. Also, the components can be dry mixed using a technique called diapering, which is done behind a barricade. With these techniques, the explosive components are generally blended first, followed by the fuels, and finally the oxidizer components.

Additionally, the present invention can also provide a method of making a priming mixture comprising: forming an aqueous priming mixture by combining and mixing water with, on a dry weight percent: about 20% to about 70% by weight of a primary explosive; about 10% to about 70% by weight of an oxidizer system comprising bismuth oxide; about 0% to about 25% by weight of a gas producing agent; about 0% to about 20% by weight of a sensitizer; and, about 0% to about 20% by weight of a reducing agent. The method of making the priming mixture can further comprise: combining and mixing a sensitizer with the aqueous priming mixture; combining and mixing a reducing agent with the aqueous priming mixture; combining and mixing a gas-producing agent with the aqueous priming mixture; or any combination thereof. Still further, the method of making the priming mixture can possibly include additional steps, such as: pelletizing the aqueous priming mixture; charging a percussion cup with the palletized priming mixture to form a charged percussion cup; or a combination thereof. The oxidizer system comprises bismuth oxide, and can be a non-hygroscopic oxidizer system, a non-corrosive oxidizer system, or a combination thereof.

By way of example and illustration, and not by limitation, the mixing and preparation of the priming mixture is illustrated below by the following steps. Other components may be added to the mixture as described above, and the recited priming mixture is not to be limited by any one proscribed process, but only by the appended claims.

The priming mixture may be prepared and applied by the following steps:

1. Within the above-described ranges, primary and secondary explosives are added in a kettle mixer with an amount of water and then mixed for approximately 2 minutes. When added to the kettle, the primary and secondary explosives generally are wet with water. This moisture generally is sufficient to wet the entire mixture.

2. Within the above-described ranges, fuels or other sensitizers are added to the wet mix of explosives and then mixed for approximately 2 minutes.

3. Within the above-described ranges, the oxidizer system containing bismuth oxide is added to the wet mix of explosives and fuel and then mixed for about 2 minutes. Subsequently, the entire mixture is mixed for about 3 minutes to form the wet mix primer.

4. The resulting wet priming mixture is rolled onto plates having holes or recesses wherein the wet mixture is formed into pellets and then punched and charged into primer cups. The resulting charged priming mixture is then covered with a paper foil and an anvil is inserted. The charged priming mixture is then typically allowed to dry for approximately 5 days at about 50° C.

The present invention also encompasses small arms ammunition cartridges that incorporated the priming mixtures described herein. The cartridges typically will include a case in which the priming mixture is disposed, although the primer mixture also could be used for caseless ammunition as well. The cartridge may include projectiles, such as shot or bullets. The cartridge also can be a centerfire cartridge for rifles, pistols and revolvers in which the primer is centrally aligned within the head of the cartridge or a rimfire cartridge having a flanged head with the priming mixture disposed in the rim cavity.

EXAMPLES

Example 1

A standard primer contains a mixture conventional formulation of 35.6% lead styphnate, 5% tetrazene, 40.6% barium nitrate, 11.9% antimony sulfide, and 6.9% aluminum with an additional 0.5% of binder (Conventional Formulation). To demonstrate the ability of bismuth oxide to act as a direct replacement for more common oxidizers, in this case barium nitrate, an alternative mixture was prepared by substituting bismuth oxide for barium nitrate in the conventional formulation. This alternative mixture is referred to as BI01. Both mixes were prepared by mixing water-wet explosives with the mentioned dry ingredients in a production fashion. Once mixed these were then assembled into small arms primers. After drying, these primers were then tested according to the SAAMI specification for small arms ammunition sensitivity. The accepted performance standard requires that no sample fires when a 1.94 ounce test weight is dropped from a height of 1 inch into the priming mixture and that all samples must fire when the weight is dropped from a height of 11 inches.

When the priming mixture was tested in 38 Special shells, the results of Table 1 were obtained.

TABLE 1

| 50 samples tested at each level | | |
|---|---|---|
| | Conventional Formulation | BI01 |
| all fire height, in. | 6 | 6 |
| all no-fire height, in. | 2 | 2 |
| X-bar | 3.62 | 4.16 |
| X-bar + 4σ | 6.35 | 7.11 |
| X-bar − 2σ | 2.26 | 2.68 |

From the results of the sensitivity test shown in Table 1, it is apparent that although there is some difference in sensitivity between the two, both samples are well within the SAAMI guidelines, and it can be seen that the bismuth oxide in BI01 meets the SAMMI performance standards.

An additional comparison was performed by using the above two primer samples and loading them into 9 mm rounds of ammunition using 115 grain metal case bullet and Bullseye® propellant. The loaded 9 mm rounds of ammunition were then fired at various temperatures while measuring peak chamber pressure and muzzle velocity. Table 2 indicates the results when tested in 9 mm ammunition.

TABLE 2

| average of 50 rounds | | | | | |
|---|---|---|---|---|---|
| sample | storage | peak pressure, 100 psi | standard deviation | muzzle velocity, ft/sec | standard deviation |
| Conventional | 70° F. | 313 | 20 | 1137 | 27 |
| BI01 | 70° F. | 325 | 13 | 1215 | 19 |
| Conventional | 150° F. | 356 | 17 | 1162 | 28 |
| BI01 | 150° F. | 353 | 11 | 1267 | 16 |
| Conventional | −20° F. | 304 | 25 | 1104 | 38 |
| BI01 | −20° F. | 339 | 23 | 1202 | 29 |

The results of Table 2 indicate that the BI01 formulation containing bismuth oxide as the main oxidant performed equal to or better than the Conventional Formulation on peak pressure and exhibited higher muzzle velocity after every storage condition. The performance of the bismuth oxide primer formulation is consistent over a wide range of temperatures. In each of case, the equilibrium time was 48 hours. Also, 50 rounds were fired at each condition. Although this example was performed in 9 mm, it can be inferred that this improvement will transfer to all small arms ammunition.

Example 2

To illustrate the compatibility of bismuth oxide with other primer components and the versatility of bismuth oxide in various primer mixes, four different mixes were prepared using bismuth oxide in combination with various oxidizers. Mix descriptions are found in Table 3.

TABLE 3

| percent by weight dry ingredients | | | | |
|---|---|---|---|---|
| | BI02 | BI03 | BI04 | BI05 |
| KDNBF | 45 | 45 | 45 | 45 |
| Tetrazene | 5 | 5 | 5 | 5 |
| Bismuth Oxide | 15 | 15 | 15 | 15 |

TABLE 3-continued

| percent by weight dry ingredients | | | | |
|---|---|---|---|---|
| | BI02 | BI03 | BI04 | BI05 |
| Zinc Peroxide | 30 | | | |
| Potassium Nitrate | | 30 | | |
| Strontium Peroxide | | | 30 | |
| Molybdenum Oxide | | | | 30 |
| Titanium | 5 | 5 | 5 | 5 |

After these mixes were charged into primers, they were dried and primed into 38 Special casings, and tested according to the SAAMI specification for small pistol sensitivity. The results of the sensitivity testing are presented in Table 4.

TABLE 4

| 50 samples tested at each level | | | | |
|---|---|---|---|---|
| | BI02 | BI03 | BI04 | BI05 |
| all fire height, in. | 7 | 9 | 5 | 7 |
| all no-fire height, in. | 3 | 3 | 2 | 5 |
| X-bar | 3.86 | 5.52 | 3.28 | 5.04 |
| X-bar + 4σ | 7.14 | 11.09 | 5.29 | 7.47 |
| X-bar − 2σ | 2.22 | 2.73 | 2.28 | 3.83 |

From Table 4, it is evident that secondary oxidizers can affect the overall sensitivity of the mixture. All but one, BI03, meet the SAAMI specification for X-bar+4σ all-fire sensitivity. This does not mean that the bismuth oxide/potassium nitrate formulation will not perform satisfactorily; a simple alteration to the ratio of the two components can change the sensitivity to meet the specification.

Additional information about each formulation was gathered when each was fired in a semi-closed primer bomb. The results of semi-closed primer bomb are found in Table 5.

TABLE 5

| average of 10 primers fired for each sample | | | | |
|---|---|---|---|---|
| | BI02 | BI03 | BI04 | BI05 |
| time-to-1$^{st}$-rise, μs | 0.273 | 0.295 | 0.366 | 0.434 |
| rise time, μs | 0.106 | 0.117 | 0.200 | 0.293 |
| peak pressure, psi | 242 | 271 | 138 | 171 |
| temperature, K | 1464 | 1675 | 1494 | 1453 |

The data set forth in Table 5 reveals performance variations linked to the selected primary oxidant. This data shows the efficiency of the inorganic nitrate as an oxidizer. To determine how these outputs affected the ballistics properties of loaded ammunition, the above primers were loaded into 9 mm cartridges using a 101 grain frangible bullet with 6.2 grains of HPC-33 propellant. The internal ballistics peak pressure and muzzle velocity for each was obtained. Ballistics data is found in Table 6.

TABLE 6

| average of 10 rounds | | | | |
|---|---|---|---|---|
| | BI02 | BI03 | BI04 | BI05 |
| peak pressure, 100 psi | 382 | 388 | 363 | 342 |
| peak pressure extreme variation, 100 psi | 60 | 39 | 55 | 57 |
| peak pressure standard deviation | 15 | 12 | 17 | 20 |
| muzzle velocity, ft/sec | 1306 | 1317 | 1287 | 1278 |
| muzzle velocity extreme variation, ft/sec | 69 | 57 | 62 | 70 |
| muzzle velocity standard deviation | 18 | 15 | 22 | 23 |

Holding the mass of propellant constant allows the evaluation of the primers ability to ignite the charge. The comparison in Table 6 reveals the effects of changing the dominate oxidant has on ballistics performance. When comparing the effect the different combinations have on primer bomb output, it appears the use of strontium peroxide or molybdenum trioxide drastically decreased the output. However the decreased output was not detrimental to propellant ignition. In any event, the above example demonstrates bismuth oxide's capacity to function in combination with other oxidizers in small arms ammunition. Furthermore, it must be understood that only one type of propellant was used in this example, it maybe the case that the strontium peroxide or molybdenum trioxide containing primers may perform better when using alternative propellant. Although this is just a few of the unlimited number of possible combinations, it highlights bismuth oxide's capacity to be used in combination with other oxidizers to tailor primer performance.

Example 3

Again the versatility of bismuth oxide is demonstrated in this example where its use as the sole oxidizer in combination with a variety of fuels is presented. As shown in Table 7, eight formulations were produced in which all components and their percentages were kept constant, except that the type of fuel was varied.

TABLE 7

| percent dry ingredients by weight | | | | | | | | |
|---|---|---|---|---|---|---|---|---|
| | BI06 | BI07 | BI08 | BI09 | BI10 | BI11 | BI12 | BI13 |
| KDNBF | 45 | 45 | 45 | 45 | 45 | 45 | 45 | 45 |
| Tetrazene | 5 | 5 | 5 | 5 | 5 | 5 | 5 | 5 |
| $Bi_2O_3$ | 45 | 45 | 45 | 45 | 45 | 45 | 45 | 45 |
| Al | 5 | | | | | | | |
| B | | | | 5 | | | | |
| $CaSi_2$ | | | | | | | 5 | |
| Mg | | | | | | | | 5 |
| MgAl Alloy | | | | | 5 | | | |
| Si | | 5 | | | | | | |
| Ti | | | 5 | | | | | |
| Zr | | | | | | 5 | | |

Once the primer formulations were produced, they were tested for sensitivity in 38 Special casings according to SAAMI specifications. The results of the sensitivity testing are presented in Table 8.

TABLE 8

| 50 samples tested at each level | | | | | | | | |
|---|---|---|---|---|---|---|---|---|
| | BI06 | BI07 | BI08 | BI09 | BI10 | BI11 | BI12 | BI13 |
| all fire height, in. | 7 | 7 | 7 | 6 | 7 | 5 | 5 | 6 |
| all no-fire height, in. | 3 | 3 | 3 | 2 | 2 | 2 | 2 | 2 |
| X-bar | 4.92 | 4.84 | 4.26 | 3.44 | 3.58 | 3.50 | 3.34 | 3.66 |
| X-bar + 4σ | 8.03 | 8.81 | 7.10 | 5.30 | 5.64 | 5.10 | 5.19 | 5.39 |
| X-bar − 2σ | 3.37 | 2.86 | 2.84 | 2.51 | 2.20 | 2.70 | 2.41 | 2.5 |

Each primer formulation met or exceeded the SAAMI specifications for primer sensitivity. Consequently, it is evident that bismuth oxide performs well with a variety of fuels. However, sensitivity is just one of the criteria that a primer must meet. Therefore, the ballistic characteristics of the primer formulations were tested by loading the primers into 9 mm 101 frangible rounds using 6.2 grains of HPC-33. The results are set forth in Table 9.

TABLE 9

| average of 10 samples | | | | | | | | |
|---|---|---|---|---|---|---|---|---|
| | BI06 | BI07 | BI08 | BI09 | BI10 | BI11 | BI12 | BI13 |
| peak pressure, 100 psi | 368 | 407 | 395 | 385 | 389 | 407 | 397 | 385 |
| peak pressure extreme variation, 100 psi | 33 | 67 | 45 | 84 | 50 | 82 | 64 | 56 |
| peak pressure standard deviation | 11 | 19 | 13 | 26 | 16 | 22 | 23 | 21 |
| muzzle velocity, ft/sec | 1297 | 1283 | 1278 | 1273 | 1285 | 1284 | 1279 | 1309 |
| muzzle velocity extreme variation, ft/sec | 37 | 47 | 45 | 37 | 34 | 11 | 46 | 38 |
| muzzle velocity standard deviation | 12 | 16 | 14 | 13 | 11 | 4 | 14 | 13 |

The results illustrate the versatility and compatibility of bismuth oxide in a variety of primer formulations that can be used in small arms ammunition.

Example 4

The versatility of bismuth oxide is further demonstrated in this example where the compatibility of bismuth oxide with different primary explosives is shown in Table 10. Three primer formulations using bismuth oxide were prepared by varying only the type of explosive.

TABLE 10

| percent dry ingredients | | | |
|---|---|---|---|
| | BI14 | BI15 | BI16 |
| Lead Styphnate | 28 | | |
| KDNBF | | 28 | |
| DDNP | | | 28 |
| Tetrazene | 8 | 8 | 8 |
| Bismuth Oxide | 48 | 48 | 48 |
| NC powder fines | 6 | 6 | 6 |
| Aluminum | 10 | 10 | 10 |

These three formulations processed equally well and after primers were prepared, they preformed comparably well in sensitivity testing, as shown in Table 11.

TABLE 11

| 50 samples tested at each level | | | |
|---|---|---|---|
| | BI14 | BI15 | BI16 |
| all fire height, in. | 5 | 6 | 5 |
| all no-fire height, in. | 2 | 2 | 2 |
| X-bar | 3.66 | 3.92 | 3.8 |
| X-bar + 4σ | 5.83 | 6.20 | 5.95 |
| X-bar − 2σ | 2.57 | 2.78 | 2.72 |

From the above data it becomes apparent that bismuth oxide performs equally well when combined with a variety of explosives.

While various embodiments have been set forth as illustrated and described above, it is recognized that numerous variations may be made with respect to relative weight percentages of various constituents in the composition. Therefore, while the invention has been disclosed in various forms only, it will be obvious to those skilled in the art that many additions, deletions and modifications can be made without departing from the spirit and scope of this invention, and no undue limits should be imposed, except as to those set forth in the following claims.

What is claimed is:

1. A priming mixture comprising:

a primary explosive comprising up to approximately 70% of the priming mixture by weight;

a substantially non-hygroscopic oxidizer system comprising bismuth oxide, and having a texture sufficient to enable the oxidizer system to flow and form a substantially homogenous priming mixture when blended with the primary explosive; and wherein the oxidizer system comprises approximately 20%-70% of the priming mixture by weight, and includes between about 1%-100% bismuth oxide by weight of the oxidizer system; and a gas producing agent present in amount of about 5% to about 25% by weight of the priming mixture.

2. The priming mixture of claim 1, wherein the primary explosive comprises a compound selected from salts of trinitroresorcinol (TNR), salts of dinitrobenzofuroxan (DNBF), diazodinitrophenol (DDNP), salts of 5-nitrotetrazole, salts of fulminate, salts of hydrazoic acid, tetrazene, salts of tetrazene, silver salt of tetrazene, cuprous salt of tetrazene, salts of amino guanidine, salts of cyanamide, nitrocyanamide salts, nitrophenol salts, nitrosophenol salts, nitramine salts, salts of metazonic acid, oxalic salts, peroxides, acetylide salts, nitrogen sulphide, nitrogen selenide, thiocyanic salts, silver perchlorate, hexanitromannitol, barium trinitroresorcinol, thallium trinitroresorcinol, barium-lead trinitroresorcinol, copper-lead trinitroresorcinol, calcium-barium trinitroresorcinol, sodium dinitrobenzofuroxan, potassium dinitrobenzofuroxan, silver dinitrobenzofuroxan, mercury fulminate, lead azide, lead styphnate, silver azide, or any combination thereof.

3. The priming mixture of claim 1, wherein the oxidizer system further comprises a secondary oxidizer selected from zinc peroxide, manganese dioxide, molybdenum trioxide, strontium nitrate, strontium peroxide, tin oxide, iron oxide, potassium nitrate, barium nitrate, or any combination thereof.

4. The priming mixture of claim 1, wherein the gas producing agent is selected from pentaerythritol tetranitrate, trinitrotoluene, or a combination thereof.

5. The priming mixture of claim 1, further comprising a reducing agent selected from aluminum, boron, calcium silicide, magnesium, magnesium-aluminum alloy, silicon, titanium, tungsten, zirconium, nitrocellulose, or any combination thereof.

6. The priming mixture of claim 1, further comprising a sensitizer selected from tetrazene, ground glass, or a combination thereof.

7. The priming mixture of claim 1, and further comprising a conducting component selected from aluminum, carbon black, titanium, zirconium, silver, gold, uranium, lead azide, silver azide, or any combinations thereof.

8. The priming mixture of claim 1 and further comprising:

0% to about 30% by weight of a sensitizer;

0% to about 20% by weight of a reducing agent; and

0% to about 20% by weight of a conductive component.

9. A priming mixture comprising:

from about 20% about 70% by weight of a primary explosive;

from about 10% to about 70% by weight of a substantially non-hygroscopic oxidizer system comprising approximately 5%-100% bismuth oxide and having a texture sufficient to flow with the primary explosive to form a substantially homogeneous priming mixture when the oxidizer system is blended with the primary explosive;

from about 5% to about 25% by weight of a gas producing agent;

from about 5% to about 20% by weight of a sensitizer;

from about 5% to about 20% by weight of a reducing agent; and from about 0% to about 20% by weight of a conductive component.

10. The priming mixture of claim 9, wherein the wherein the primary explosive comprises a compound selected from metal salts of trinitroresorcinol, metal salts of dinitrobenzofuroxan, potassium dinitrobenzofuroxane (KDNBF), diazodinitrophenol (DDNP), mercury fulminate, lead azide, lead styphnate, silver azide, tetrazene, metal salts of 5-nitrotetrazole, or any combination thereof.

11. The priming mixture of claim 9, wherein the oxidizer system further comprises a secondary oxidizer selected from zinc peroxide, manganese dioxide, molybdenum trioxide, strontium nitrate, strontium peroxide, tin oxide, iron oxide, potassium nitrate, barium nitrate, or any combination thereof.

12. The priming mixture of claim 9, wherein the gas producing agent is selected from pentaerythritol tetranitrate, trinitrotoluene, or a combination thereof.

13. The priming mixture of claim 9, wherein the reducing agent is selected from aluminum, boron, calcium silicide, magnesium, magnesium-aluminum alloy, silicon, titanium, tungsten, zirconium, nitrocellulose, or any combination thereof.

14. The priming mixture of claim 9, wherein the sensitizer is selected from tetrazene, ground glass, or a combination thereof.

15. The priming mixture of claim 9, wherein the conducting component is selected from aluminum, carbon black, titanium, zirconium, silver, gold, uranium, lead azide, silver azide, or any combinations thereof.

16. The priming mixture of claim 9, wherein the priming mixture comprises from about 0.1% to about 10% by weight of the conductive component.

17. The priming mixture of claim 9, further comprising up to about 2.0% by weight of a binder.

18. A method of preparing a priming mixture for detonation of explosive devices including small arms ammunition, comprising:

mixing a primary explosive material comprising approximately 20% to approximately 70% by weight of the priming mixture with water in an amount sufficient to substantially wet the priming mixture and form a wet explosive mixture;

adding to and mixing with the wet explosive mixture about 5% to about 25% by weight of a gas producing agent and at least one of:

about 0% to about 30% by weight of a sensitizer; and about 0% to about 20% by weight of a reducing agent; and about 0% to about 20% by weight of a conductive component;

blending a substantially non-hygroscopic, non-toxic oxidizer system into the wet explosive mixture, the oxidizer system comprising about 10% to about 70% by weight of the priming mixture, and including approximately 1% to approximately 100% bismuth oxide by weight of the oxidizer system and having a texture sufficient to form a substantially homogeneous priming mixture after blending with the wet explosive mixture; and drying the mixture.

19. The method of claim 18, further comprising adding about 0.1% to about 20% by weight of a conductive component to the wet primary explosive mixture.

20. The method of claim 18 wherein drying the wet priming mixture comprises applying the wet priming mixture to a plate having a series of recesses in which the wet priming mixture is formed into pellets.

* * * * *